US008858195B2

(12) United States Patent
Gonzalez-Moratiel Alvarez

(10) Patent No.: US 8,858,195 B2
(45) Date of Patent: Oct. 14, 2014

(54) DOUBLE-MEMBRANE CENTRAL-FLOW PUMP

(75) Inventor: Alberto Gonzalez-Moratiel Alvarez, Asturias (ES)

(73) Assignee: Samoa Industrial S.A., Asturias (ES)

( * ) Notice: Subject to any disclaimer, the term of this patent is extended or adjusted under 35 U.S.C. 154(b) by 46 days.

(21) Appl. No.: 13/698,075

(22) PCT Filed: May 18, 2011

(86) PCT No.: PCT/ES2011/000162

§ 371 (c)(1),
(2), (4) Date: Jan. 22, 2013

(87) PCT Pub. No.: WO2011/144772

PCT Pub. Date: Nov. 24, 2011

(65) Prior Publication Data

US 2013/0115117 A1 May 9, 2013

(30) Foreign Application Priority Data

May 18, 2010 (ES) ..... 201000633

(51) Int. Cl.
*F04B 45/00* (2006.01)
*F04B 43/06* (2006.01)
*F04B 43/073* (2006.01)

(52) U.S. Cl.
CPC ..... *F04B 43/073* (2013.01); *F04B 43/0736* (2013.01)
USPC ..... 417/395

(58) Field of Classification Search
USPC ..... 417/46, 393–395
See application file for complete search history.

(56) References Cited

U.S. PATENT DOCUMENTS 3,838,946 A * 10/1974 Schall ..... 417/395
3,849,033 A * 11/1974 Schall ..... 417/454
4,019,838 A * 4/1977 Fluck ..... 417/393
4,381,180 A 4/1983 Sell (Continued)

FOREIGN PATENT DOCUMENTS

DE 3909800 9/1990
EP 0132913 2/1985

OTHER PUBLICATIONS

International Search Report for PCT/ES2011/000162 Dated Mar. 10, 2011.

*Primary Examiner* — Devon Kramer
*Assistant Examiner* — Amene Bayou
(74) *Attorney, Agent, or Firm* — B. Aaron Schulman, Esq.; Stites & Harbison, PLLC.

(57) ABSTRACT

A central flow double diaphragm pump controlled by an operating fluid distribution module with a pivoting sealing member and protruding wing, that pivots on a low friction seal. The pump also includes a central pump body having an inlet and discharge manifolds, and two pumped fluid chambers in the central pump body each including a pumped fluid chamber inlet port and outlet port; within each chamber the inlet port is positioned higher than the outlet port. Two suction check valves are located in the central body, close to the suction inlet, above the pump's shaft, and these valves' outlets connect directly to the pumped fluid chamber inlet ports. Two discharge check valves are located in the central pump body, close to the discharge outlet and below the shaft, and the pumped fluid chamber outlet ports connect directly to these valves' inlets. Removable access caps are included above the check valves.

11 Claims, 6 Drawing Sheets

(56) References Cited

U.S. PATENT DOCUMENTS

| | | | | |
|---|---|---|---|---|
| 4,386,888 | A * | 6/1983 | Verley | 417/393 |
| 4,496,294 | A * | 1/1985 | Frikker | 417/393 |
| 6,158,982 | A * | 12/2000 | Kennedy et al. | 417/397 |
| 6,241,487 | B1 | 6/2001 | Reynolds | |
| 6,257,845 | B1 * | 7/2001 | Jack et al. | 417/395 |
| 6,357,723 | B2 * | 3/2002 | Kennedy et al. | 251/322 |
| 6,402,486 | B1 * | 6/2002 | Steck et al. | 417/395 |
| 6,435,845 | B1 * | 8/2002 | Kennedy et al. | 417/395 |
| 6,644,941 | B1 * | 11/2003 | Able et al. | 417/393 |
| 6,695,593 | B1 * | 2/2004 | Steck et al. | 417/395 |
| 6,957,952 | B1 * | 10/2005 | Steck et al. | 417/395 |
| 7,134,849 | B1 * | 11/2006 | Steck et al. | 417/384 |
| 7,658,598 | B2 * | 2/2010 | Reed et al. | 417/395 |
| 2004/0047749 | A1 | 3/2004 | Roberts et al. | |
| 2006/0104829 | A1 * | 5/2006 | Reed et al. | 417/350 |

* cited by examiner

DOUBLE-MEMBRANE CENTRAL-FLOW PUMP

THE INVENTION

The present invention is regarding a central flow double diaphragm pump controlled by an upper directional air valve module. The air valve module uses a pivoting sealing member with a protruding wing to distribute the operating fluid, that may be compressed air or another pressurized fluid, to drive the diaphragms. The pump comprises two inlet ports to and two outlet ports from the respective pumped fluid chambers in a special arrangement. These ports incorporate four check-valves (for example, but not necessarily, ball valves) also in a special arrangement. The diaphragms, that are elastomeric and may include a layer of PTFE (polytetrafluoroethylene) or other material that is inert to chemicals, have a special design and incorporate a central internal disc. The shaft of the pump, between the two diaphragms, may reciprocate freely and is not fastened to the diaphragms. Compared to existing similar flow rate pumps, when pumping the same volume of fluid during the same time, the present invention uses up to a third less volume of operating fluid with a corresponding reduction in energy consumption.

APPLICATION OF THE INVENTION

This invention may be used in industrial pumping applications, to pump fluids and/or fluids with solids in suspension and/or powders and/or chemically aggressive or difficult to handle fluids such as hydrocarbons, chlorinated hydrocarbons, acids, bases, and other chemicals used in industrial processes.

INVENTION BACKGROUND

There are many double diaphragm pumps in the market that may be operated by compressed air or other pressurized fluid, generally these pumps may be classified into two sets:

a) Peripheral flow pumps that alternatively pump fluid from two fluid chambers positioned at the two outermost sides of the pump. Operating fluid chambers are separated by diaphragms from the pumped fluid chambers and these operating fluid chambers are on the inside of the diaphragms.

b) Central flow pumps that alternatively pump fluid from two fluid chambers positioned at either side of the central pump body. Operating fluid chambers are separated by diaphragms from the pumped fluid chambers and these operating fluid chambers are on the outside of the diaphragms.

Advantages of diaphragm pumps compared with other pump technologies include:

- Versatility to pump a wide range of difficult to pump fluids due to, for example, being chemically aggressive or abrasive.
- Take advantage of the operating fluid pressure, for example compressed air, to allow medium pressure fluids to be pumped and also for the control and operation of the pump.
- Their design does not require the sealing systems used in rotary shaft pumps and that may leak.

Peripheral flow diaphragm pumps are the most common kind of compressed air operated diaphragm pumps. The design of these pumps implies that the pumped fluid has to pass initially through an inlet manifold that includes one, or in most cases two, ninety degree elbows. After passing through this manifold the fluid has to enter into the fluid chambers from where it is discharged through a further manifold that also includes one, and in most cases two, ninety degree elbows. So, this design introduces pressure drops, an important factor in the low energy efficiency of these pumps.

The fluid path in a central flow pump does not circulate around the outside of the pump, so avoiding the associated pressure drops and improving the pump's efficiency. However, in most cases the design of the inlets and outlets towards and from the valves of the pumping chambers involves a complicated path. Also, ducts exist between the suction valves and the chamber inlet ports and between the chamber outlet ports and the discharge valves. The design of a pump that optimizes or eliminates these ducts would offer efficiency improvement.

Both peripheral flow pumps and central flow pumps use a directional valve to switch the flow of the operating fluid from one air chamber to the other. The switching time required causes a more or less pulsating flow. In a pumping system it is better to avoid pulsating flow for various reasons, for example to avoid: losses of efficiency, vibrations in the installation, irregular fluid supply, and loss of dosing accuracy.

Regarding the overall pumping performance, the suction pressure that is available to the pump is: suction pressure=(atmospheric pressure+fluid static pressure at the inlet)−(suction pressure that the pump is capable to generate). For this reason, any improvement in the suction capacity of the pump is of great value (an improvement of 0.1 bar in the discharge performance=approximately 0.1 bar over 5 bar of discharge pressure="only" 2% of improvement, but an improvement of 0.1 bar in the suction performance=approximately 0.1 bar over 1 bar of suction height=10% improvement).

The diaphragms and check valves are essential components in all diaphragm pumps. Since they are in contact with the pumped fluid, they are available in different materials in order to maximize the pumps' range of application. Normally the diaphragms are fastened to the pump's central shaft using threaded connections and large discs, or pistons, that act on both the inside and outside of the diaphragms, to transmit the alternating driving forces to both diaphragms.

A significant factor during the working life of diaphragm pumps is the cost of maintenance. And important factors in this cost include: the cost to replace components at the end of their life (for example: diaphragms, check valves, directional valve and shaft), the labour time to service or substitute parts, and the downtime. Factors that reduce maintenance intervals are:

- Diaphragms for chemically aggressive fluids, especially those with a design to achieve high chemical resistance not based only on elastomers, for example using PTFE, tend to rupture early due to the alternating movement during each cycle and the longer the stroke the shorter the life of such diaphragms.
- The accumulation of sediments in the pump fluid chambers can lead to wear of the diaphragms and shaft when the diaphragms are forced, due to contact with these deposits, to deform to finish their stroke.
- Forces on the shaft and diaphragms when pumping against significant suction or discharge resistance.
- Pumped fluids with solids in suspension cause increased wear of the diaphragms and check valves.
- Contaminated compressed air can cause premature wear of the air valve.

Significant factors that increase the downtime and the labour time required to service or replace parts are:

- The need to disconnect the pump from the fluid lines, when to access components requiring service or replacement, the inlet and outlet manifolds of the pump need to be disassembled.

The need to disassemble the pump to access the components requiring service or replacement due to a design that does not facilitate access to these parts.

When the pumped fluid is a dangerous fluid, then the disconnection of the fluid lines and the maintenance has to be realized with particular care to avoid spills and operator contact with the fluid.

Should it be possible to increase the velocity of the stroke direction change over in a diaphragm pump and increase the cycling frequency, then this would reduce the negative effects of the fluid pulsations and it would be possible to reduce the stroke length, without reducing the flow rate, (flow rate=cycle frequency×volume pumped per cycle), and so increase diaphragm life. However, this requires a faster directional valve. Many designs of directional valves have evolved to reduce problems such as air leaks and/or poor operating reliability for pump starting and stopping. However, to reduce the air leaks, seals and lubricants are used that, unfortunately, may become contaminated and cause directional valve sticking and this can lead to pump start-up failures or undesired pump stopping. It is essential that a new directional valve does not leak air and delivers reliable pump start-up and running.

Various central flow pumps exist with the characteristics previously mentioned, for example EP-0823023/EP-1029185 and of special mention the pump EP-0132913 owned by FLOTRONICS AG. Such pumps comprise two chambers and four check valves, and a shaft that pushes the diaphragms. However, no pumps are known that incorporate all of the characteristics of the present invention comprising:

Check valves located in the centre of the pump that are accessible from above, with the suction valves at a different level than the discharge valves.

Fluid inlet ports to the chambers located above the shaft and within the chamber and fluid outlet ports from the chambers located below the shaft and within the chamber.

A pivoting sealing member to distribute the air whose special protruding wing breaks the symmetrical functioning of the pump and so prevents the pivoting sealing member, and as a consequence prevents the pump, from stopping.

A special diaphragm design.

Diaphragms assembled freely without any fastening to the shaft.

Consequently, no pump is known that offers simultaneously all the innovations described and the functional advantages of the present invention.

DESCRIPTION OF THE INVENTION

The following terminology is used:

AIR/COMPRESSED AIR=compressed air or any other pressurized operating fluid.

FLUID=pumped fluid that could be a liquid, a liquid with particles in suspension or air with particles in suspension.

AIR DISTRIBUTION MODULE=topside module that distributes compressed air, using a low friction pivoting sealing member with a protruding wing.

PIVOT VALVE=pivoting sealing member with a protruding wing.

BALL VALVES=two suction valves and two discharge valves that in the present invention are presented as ball valves, but which could be flap, or flat or any other kind of check valves.

The present invention is a special design of double diaphragm pump that, compared to similar flow rate pumps, when pumping the same volume of fluid, uses up to a third less volume of compressed air with a corresponding reduction in energy consumption. This pump eliminates air leaks, starts up reliably without stopping or stalling, delivers a less pulsing flow, and increases the operating life of the diaphragms. The cleaning and replacement of the diaphragms and the ball valves (or other type of check valves) is possible directly, simply and quickly, since there is no need to disconnect the fluid lines nor disassemble completely the pump. Consequently, thanks to the reduced time required, such maintenance is much more economical.

The present invention comprises a specially configured central flow double diaphragm pump with a fluid inlet manifold (16) a fluid outlet manifold (17), and two external lateral chambers (1 and 2) that each comprise an air chamber (1.1 and 2.1) and a fluid chamber (1.2 and 2.2), and a central body located between these chambers (3). Each lateral chamber includes a diaphragm (4) that separates the air chambers (1.1 and 2.1) from the fluid chambers (1.2 and 2.2). The air chambers are on the outermost sides and are further enclosed by a chamber cover (14). The air chambers are operated by compressed air, or a different pressurized operating fluid. The compressed air is controlled by a pivoting sealing member with a protruding wing so that the diaphragms are alternatively displaced by the compressed air. The central shaft (6) is displaced and the centre of the diaphragms contact their respective end of stroke sensor (5). Hence, an alternating to and fro movement is produced sucking fluid into and discharging fluid from the wetted side of each chamber.

More specifically, the present invention comprises:

1. Regarding the control and operating system:

LOW FRICTION PIVOTING SEALING MEMBER WITH A PROTRUDING WING (8). A pivoting sealing member with a protruding wing is included in the operating fluid distribution module (7). The pivoting sealing member (8) includes an inlet sealing cylinder with a sealing lip (8.1) for each of the two inlets, a protrusion with a truncated spherical surface (8.2), an outlet sealing cylinder with a sealing lip (8.4) for each of the two outlets and a protruding wing (8.5) whose tip faces the incoming operating fluid flow. The protrusion (8.2), is supported by, pivots against and seals against the distribution module's low friction seal (8.3). The pivoting sealing member moves freely around its truncated spherical protrusion with minimal friction, this enables a very high velocity change of position. The seal between the truncated spherical protrusion and the low friction seal prevents operating fluid leaks and hence unnecessary energy use. For example, when the pump is controlled using a valve in the pumped fluid discharge line, it is possible to leave the pump with pressurized operating fluid and pumped fluid without any operating fluid leak and without any movement.

THROTTLE VALVE (9). A throttle valve is included in only one of the operating fluid channels, to break the symmetrical functioning of the pump and so prevent the pump from stopping or stalling. This reinforces the functioning of the pivoting sealing member with a protruding wing (8).

TWO SENSOR VALVES (5). A sensor valve is incorporated in each of the two chamber covers (14) and are actuated at the end of stroke of their respective diaphragms. The sensor valves comprise: a sensor chassis (5.1), a gasket (5.2), an actuating button (5.3), a ball valve seat (5.4), an o-ring seal (5.5), and a ball valve (5.6).

2. Regarding the pumped fluid chambers:

The central pump body (3), that comprises the pumped fluid chambers and is also known as the wetted body, includes a special configuration of check valves, that could be ball valves or any other kind of check valves, that allows the immediate connection between the check valve housings and the suction inlet and discharge outlet ports of the pumped fluid chambers. The manifolds commonly used in air operated double diaphragm pumps, prior to the present invention, to connect between the check valves and the pumped fluid chambers, are thus not required. The suction and discharge performance is improved significantly through immediate check valve to pumped fluid chamber connections.

FOUR VALVES, for example, ball valves. Two suction check valves (10) and two discharge check valves (11) are housed in the centre of the central body between the chambers and within the projection of the section of the diaphragms. In the case of ball valves, the valves operate with vertical movement perpendicular to the flow of fluid into and out of the pump. The two suction valves (10) are located in a horizontal plane above the two discharge valves (11). The valves connect immediately with the pumped fluid chamber inlet (12) and outlet (13) ports.

AN INLET PORT (12) AND OUTLET PORT (13) in both of the pumped fluid chambers. The housings of the check valves form the inlet and outlet ports. The inlet ports (12) are above the central shaft (6) and the outlet ports (13) are below the central shaft. This arrangement ensures a fluid flow from the top towards the bottom and prevents zones of zero and very low flow velocity, and so prevents sedimentation in the fluid chambers of solid particles that are carried in suspension. The particles in suspension are discharged through the outlet ports (13). This increases the life of the diaphragms and the shaft, since otherwise sedimentation of particles damages the diaphragms and shaft due to wear and mechanical distortions caused by deposits of particles.

The present invention solves these existing problems caused by sedimentation, through the positioning of the pumped fluid inlet and outlet ports at different levels and within the projected section of the chambers. So, the suction inlets are at a higher level than the discharge outlets to encourage the expulsion of solids from the pump. This contrasts with existing pumps, wherein the fluid chamber suction port is towards the bottom of the chamber.

The present invention also allows the simultaneous suction of two fluids, by dividing the pumped fluid inlet manifold in two. The pumped fluid inlet manifold diverts the two pumped fluids to each inlet port of different pumped fluid chambers. The two fluids are mixed in the pumped fluid outlet manifold.

TWO DIAPHRAGMS (4) each with a profile that fits to the profile of the two chamber covers (14) and to the external sides of the two pumped fluid chambers (1.2) and (2.2). The design of these diaphragms accomplishes two functions:

1. The perfect fit of the diaphragms to the pumped fluid chambers ensures a leak proof seal.

2. The diaphragms are made with an elastomer in a shape that, when the diaphragms are in their initial or relaxed state, fits to the profile of the chamber covers (14). During its discharge cycle a diaphragm stores elastic energy from the operating fluid. Then, during its suction cycle, the diaphragm releases this energy, and so assists the pump's suction cycle. During the suction cycle the suction diaphragm is also pushed by the central shaft, which acts freely from both diaphragms so that no forces are produced that would otherwise shorten the shaft's and diaphragms' life. This even applies in extreme situations, such as during cavitation, dry running, and throughout the shaft's life when, due to wear, play may be introduced into the shafts movements. The pivoting sealing member with a protruding wing allows a faster stroke direction changeover and higher frequency switching than existing shuttle valves, and so enables the diaphragms to be driven with shorter strokes. The faster stroke direction changeover reduces pulsations and shorter strokes increases diaphragm life. Minimizing pulsations also reduces flow resistance within the pump and so achieves a significant saving in energy consumption.

The present invention includes, in addition to the previously mentioned four check valves (two suction valves (10) and two discharge valves (11)), check valve access caps (15) which are all accessible from the same side of the pump, from beneath the operating fluid distribution module. The check valve access caps allow a direct and simple access to the check valves for cleaning or replacing the valves. Hence, whenever these operations should be necessary the pump downtime for maintenance can be reduced to a minimum, since it is only necessary to disassemble the operating fluid distribution module and the check valve access caps to reach the valves. So, during check valve maintenance the pump can remain connected in the fluid line; it is not necessary to disconnect the pumped fluid suction and discharge hoses.

Similarly, the design and side arrangement of the chamber covers and diaphragms allows the diaphragms to be replaced by only disassembling the chamber covers and replacing the diaphragms, which are not fastened to the shaft. Again, the pump can remain connected in the fluid line; it is not necessary to disconnect the pumped fluid suction and discharge hoses.

The possibility to replace the check valves or the diaphragms without disconnecting the pump from the fluid line is of special importance when these pumps are used to pump chemically aggressive fluids. Here not only can downtime and repair time be reduced to a minimum, but, even the health and safety risks associated with handling such fluids can be reduced. In the case of high value pumped fluids, the amount of fluid lost during maintenance can also be minimized.

DESCRIPTION OF THE DRAWINGS

To complement this description of the present invention, and in order to communicate a better understanding of the characteristics of the invention, a set of drawings is included below. These drawings are illustrative but not restrictive.

PREFERRED EMBODIMENT OF THE INVENTION

Figure 1:
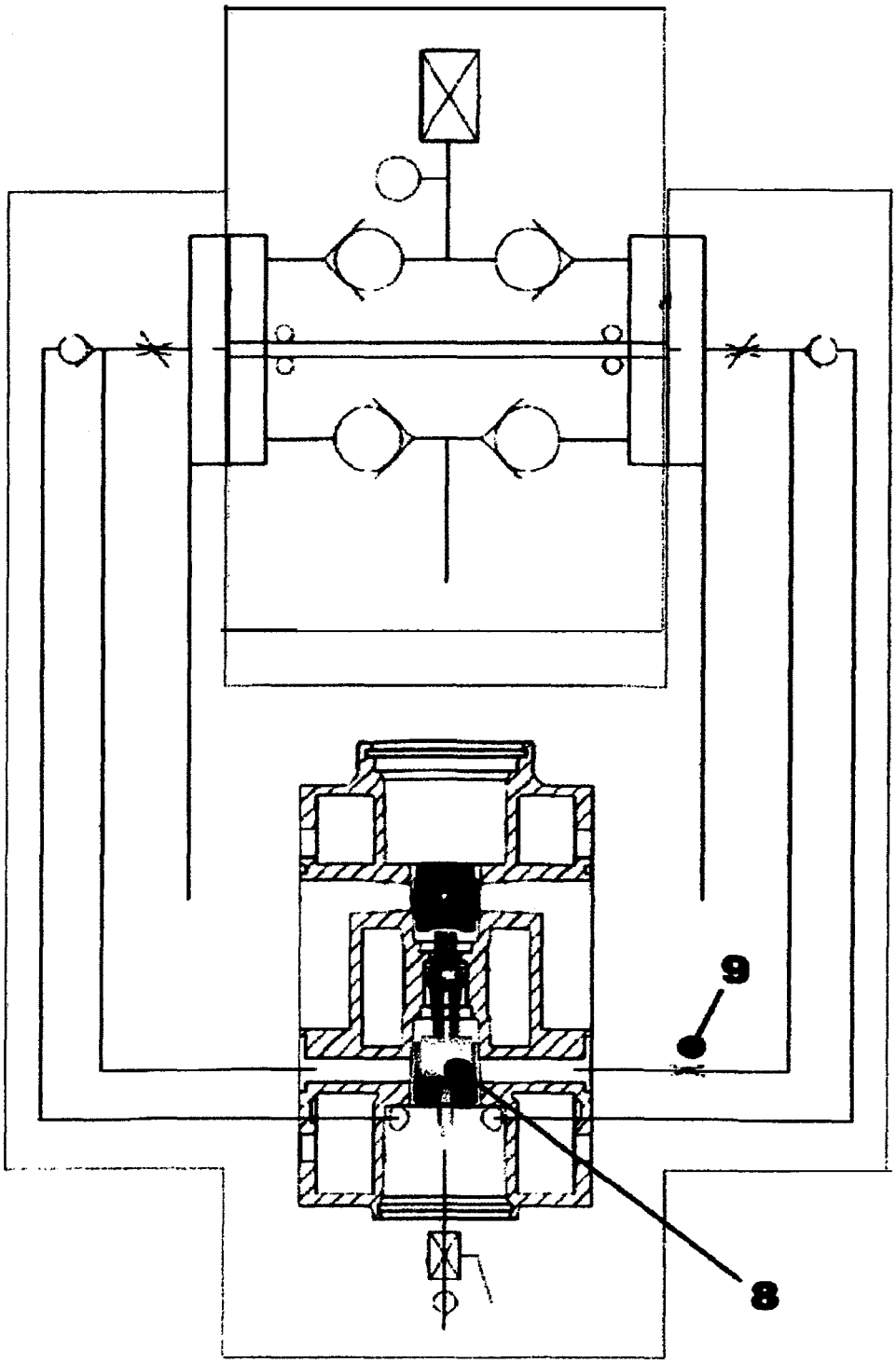
FIG. 1, is a functional diagram of the pump.
Figure 2:
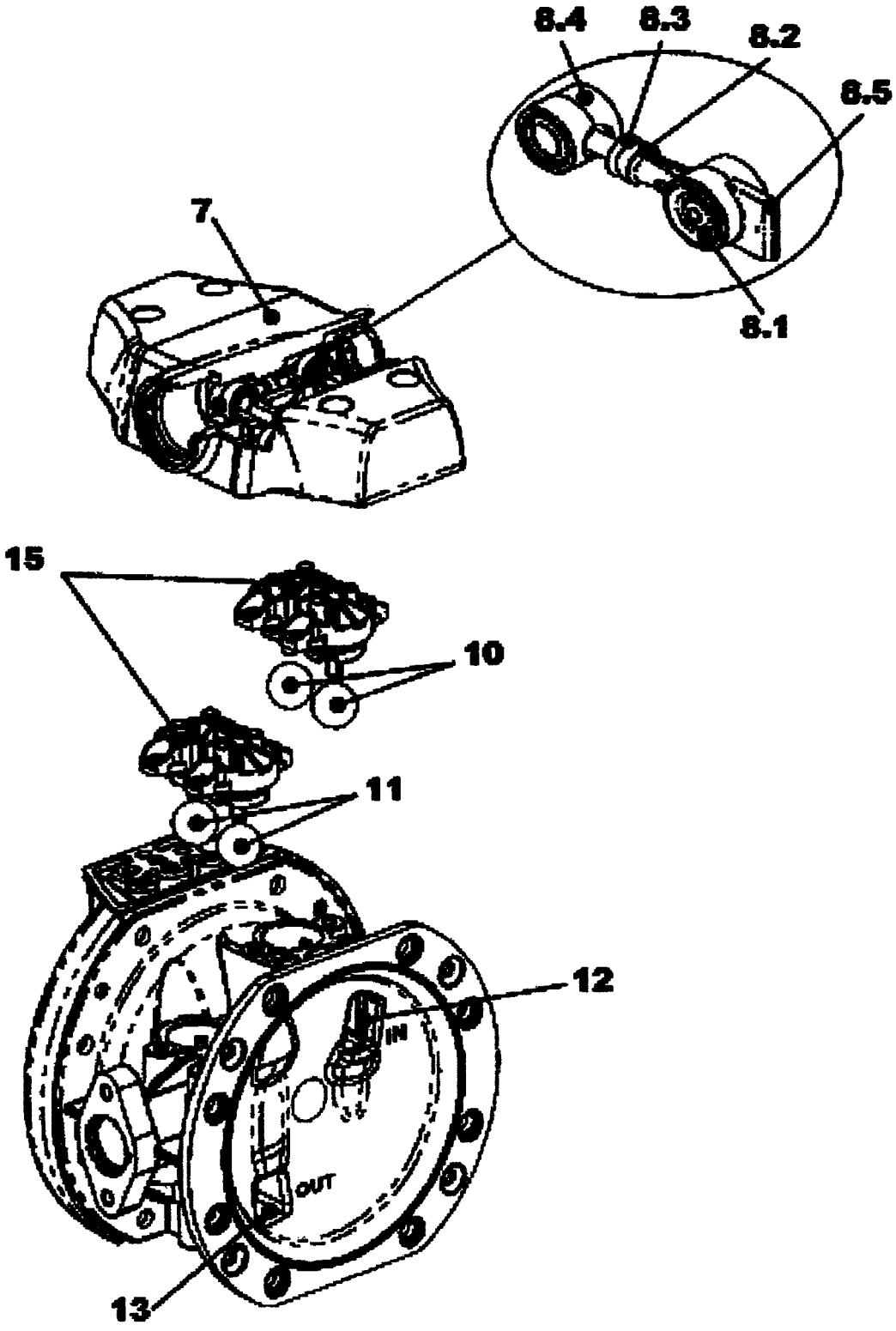
FIG. 2, illustrates the operating fluid distribution module, the ball valves, the check valve access caps, and the central pump body, and includes a detailed view of the pivoting sealing member.
Figure 3:
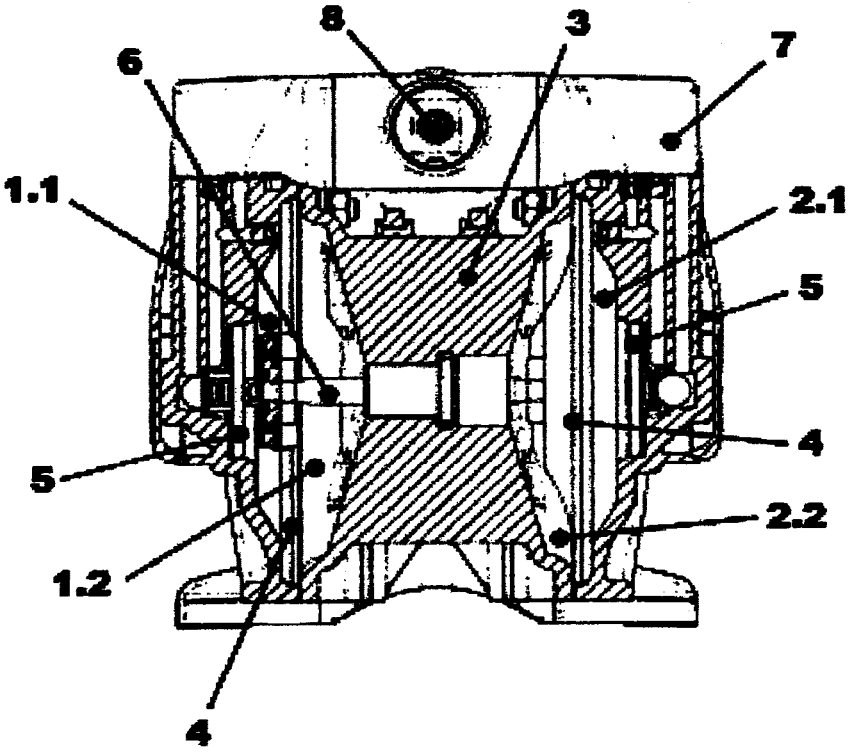
FIG. 3, is a section of the front view of the pump.
Figure 4:
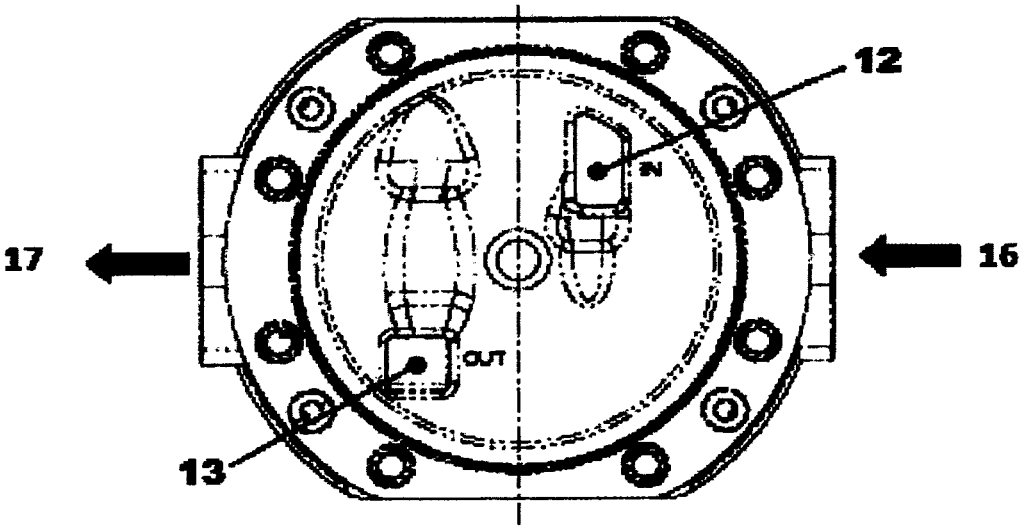
FIG. 4, is a side view of the central pump body, including the pumped fluid chamber inlet and outlet ports.
Figure 5:
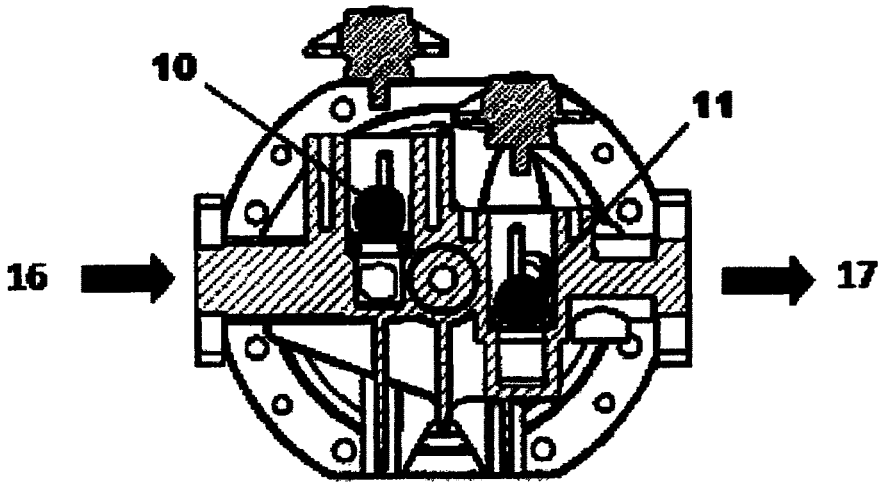
FIG. 5, is a section of the side view of the pump, including the position of the ball valves.
Figure 6:
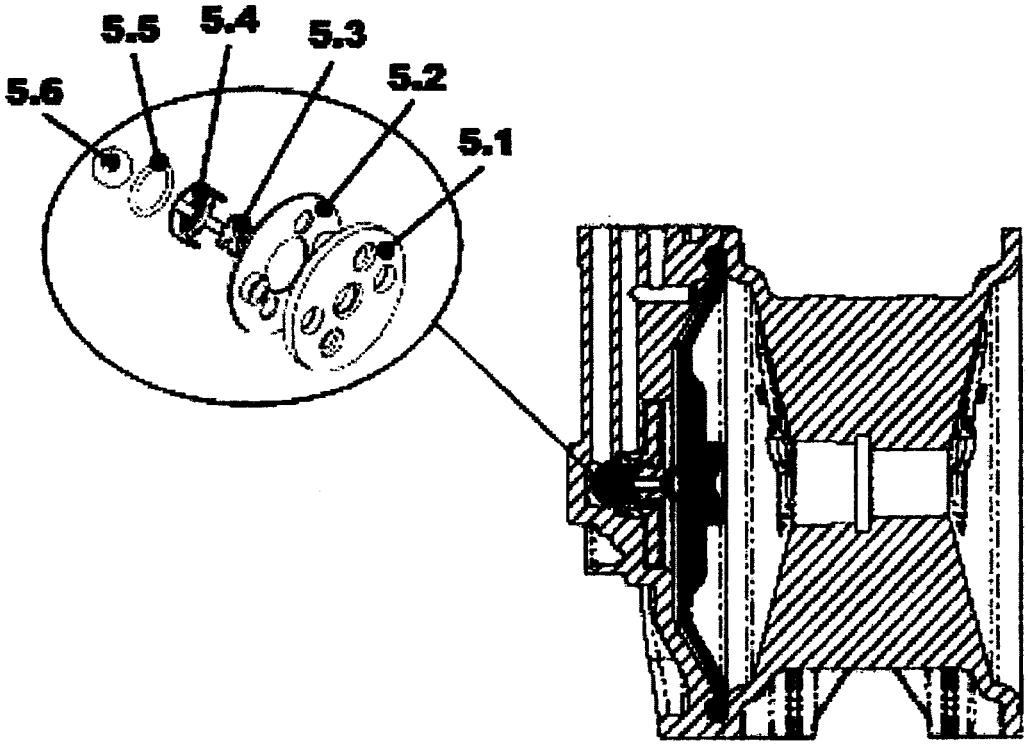
FIG. 6, is a detailed section of a partial front view of the pump, including a sensor valve and a detailed exploded view of a sensor valve.
Figure 7:
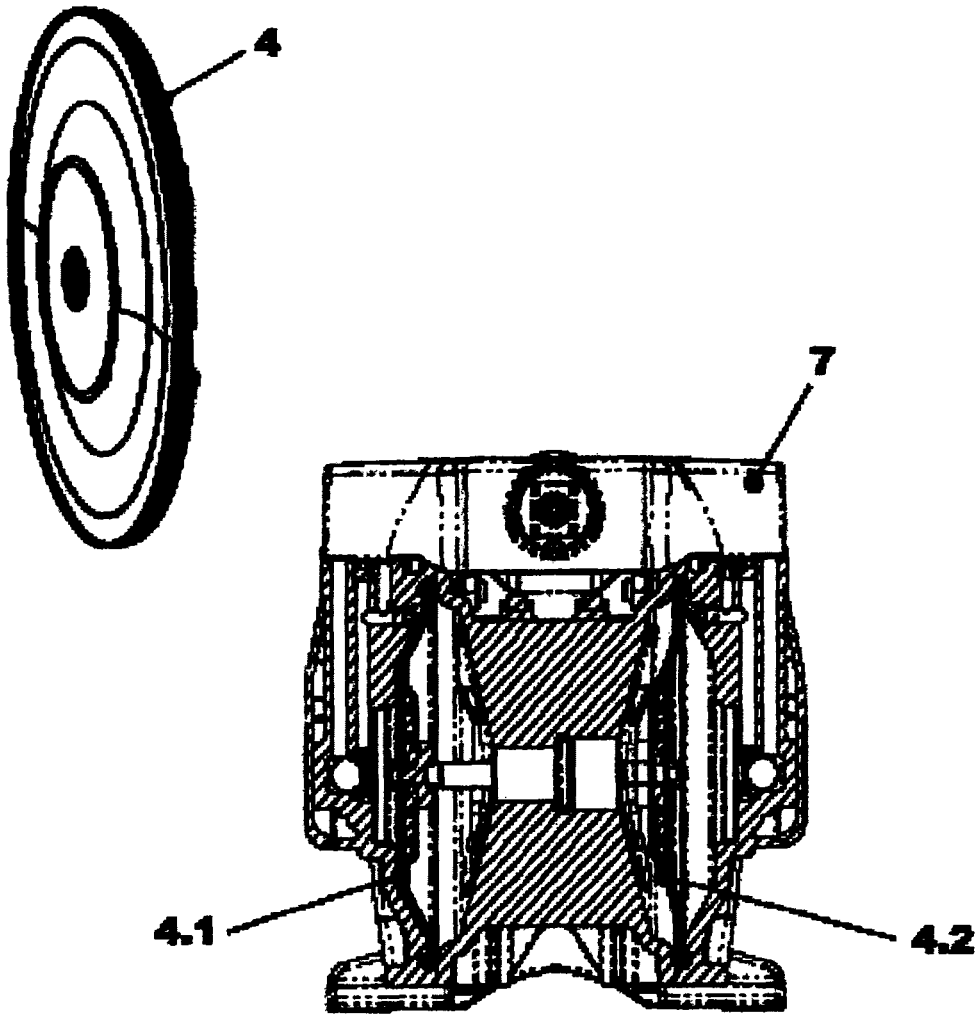
FIG. 7, is a section of the front view of the pump, where the left diaphragm (4.1) is returning to its relaxed state and the right diaphragm (4.2) is moving under operating fluid pressure and a detailed view of a diaphragm.
Figure 8:
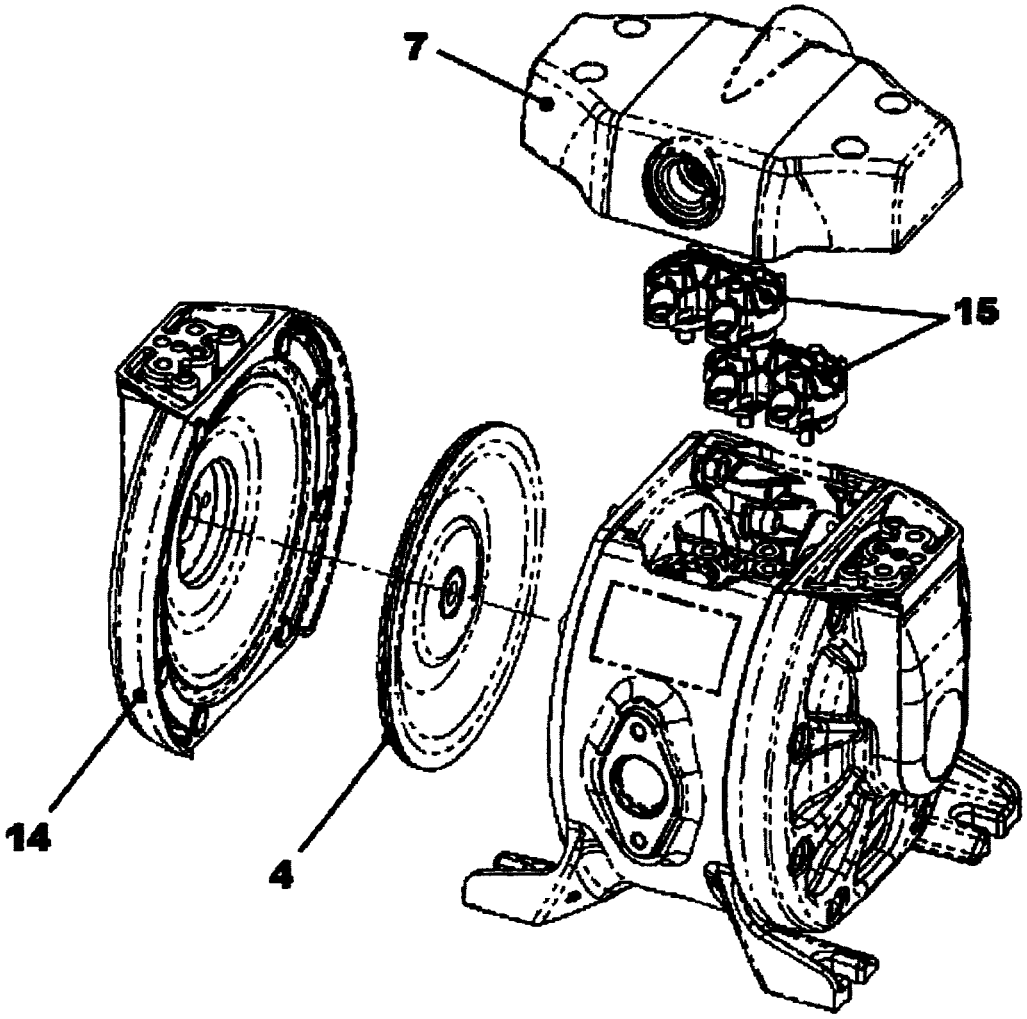
FIG. 8, illustrates the direct access to the diaphragms by removing the chamber covers (14). Also, the direct access to the check valves, by removing the operating fluid distribution module from the topside and the check valve access caps (15), is illustrated in this figure and also in FIG. 2.

The pump functions through the interaction of its following sub-systems and components:

In the control and operating sub-system:
- Operating fluid distribution module (7) with a pivoting sealing member with a protruding wing (8)
- Operating fluid channels with a throttle valve (9)
- End of stroke sensor valves (5)

In the pumped fluid sub-system:
- Diaphragms (4)
- Shaft (6)
- Check valves, for example, but not necessarily, ball valves (10), (11)
- Wetted body of the pump with pumped fluid inlet (12) and outlet (13) ports.
- Wetted body of the pump with pumped fluid inlet manifold (16) and outlet manifold (17)

When the operating fluid line connected to the operating fluid distribution module is pressurized, the pivoting sealing member with a protruding wing (8) directs the flow of operating fluid towards one of the operating fluid chambers (1.1) formed between the corresponding diaphragm (4) and chamber cover (14). Then, the diaphragm, pressurized by the operating fluid acting on one of its sides, starts to move towards the centre of the pump and as a consequence of this movement:

a) The diaphragm of the chamber (1.1) pressurized by the operating fluid starts to pressurize the pumped fluid in the adjacent fluid chamber (1.2). The pumped fluid is discharged via the chamber outlet port (13) whose check valve (for example, but not necessarily a ball valve (11)) is opened. This valve allows the pumped fluid to be discharged from the pump, but prevents the pumped fluid flowing in the opposite direction into the pump. The position of the pumped fluid chamber outlet port, below the shaft of the pump, facilitates the discharge from the chamber (1.2) of any solid particles that may be in suspension in the pumped fluid.

b) Meanwhile, the other diaphragm's stroke follows a contrary path: the fluid chamber (2.2) starts its suction cycle, opening the check valve (for example, but not necessarily, a ball valve) of the chamber inlet port (12) whilst the check valve of the chamber outlet port (13) is closed. The fluid connected to the pumped fluid inlet manifold starts to flow into the chamber. This diaphragm moves to release its elastic energy, stored during the prior deformation of the diaphragm, and due to the diaphragm in the other chamber, which is pressurized by the operating fluid, pushing against the shaft that is located between the two diaphragms.

c) During the above functioning sequences the sensor valves (5) remain closed, until the diaphragm opposite to the pressurized operating fluid chamber reaches its end of stroke and actuates its corresponding sensor valve (5).

Once the sensor valve (5) has been actuated (opened) another series of actions are triggered that affect the pivoting sealing member with a protruding wing (8) that controls the pump. When the sensor valve (5) is actuated it sends operating fluid to the inlet sealing cylinder of the pivoting sealing member (8) via the operating fluid manifold in the chamber cover. This operating fluid impulse causes the pivoting sealing member with a protruding wing (8) to change position. In its new position, the pivoting sealing member allows the operating fluid chamber (1.1) that was pressurized to exhaust to ambient, and allows operating fluid to enter and pressurize the other operating fluid chamber (2.1). The change of position of the pivoting sealing member is ensured by the protruding wing which is chamfered on one side to cause the pivoting sealing member to be forced towards one side and also is reinforced by the throttle valve (9) breaking the symmetrical functioning of the pump to prevent the pump stopping or stalling. Without the protruding wing of the pivoting sealing member and the throttle valve the pump would stop every time that the pivoting sealing member would reach a balanced position and would require an external action to start the pump up again.

At this point the stroke of the pump starts again, in the opposite direction, and in a similar way to the initial stroke explained above completes the pump's pumping cycle. These cycles are very fast and completed several time per second.

In this way, the pumped fluid chambers contained by the diaphragms alternatively suck and discharge the pumped fluid with a cycle frequency above the frequency of existing diaphragm pumps so allowing a continuous, less pulsating flow than existing diaphragm pumps to be delivered to the pump outlet.

The special design of the pump allows the diaphragms (4) and check valves (for example, but not necessarily ball valves (10) and (11)) to be replaced without disconnecting the pump from the fluid line. It is only necessary to disassemble the operating fluid distribution module (7) and remove the check valve access caps (15) to reach the check valves or remove the chamber covers (14) to replace the diaphragms that are not fastened in any way.

The invention claimed is:

1. A central flow double diaphragm pump using as an energy source, a pressurized operating fluid, and including two external lateral chambers, each chamber including a diaphragm separating an outer operating fluid chamber from an inner pumped fluid chamber, the pump comprising:

a central pump body comprising:
- two concave sides each delimiting an inner side of the respective pumped fluid chambers;
- an inlet manifold, as an integral part of the central pump body, for introducing fluid to the pump;
- an outlet manifold, as an integral part of the central pump body, for discharging fluid from the pump;
- a shaft, within a bushing, running between the centers of the central pump body's concave sides;
- two pumped fluid inlet ports and two pumped fluid outlet ports one of each within each of the two pumped fluid chambers, the inlet ports being at a different height than the outlet ports, the inlet ports being above the inlet manifold and the outlet ports being below the outlet manifold;
- two suction check valve housings between the pumped fluid chambers, each including a suction check valve, the suction check valves being above the shaft, and with the inlet manifold being connected to the inlet of each suction check valve housing and with an immediate connection from the outlet of each suction check valve housing to the respective pumped fluid inlet port, and
- two discharge check valve housings between the pumped fluid chambers, each including a discharge check valve, the discharge check valves being below the shaft, and with an immediate connection from each pumped fluid outlet port to the inlet of the respective discharge check valve housing and with the outlet of each of the discharge check valve housings being connected to the outlet manifold;

two check valve access caps the valves being independent of:

the connections between the inlet manifold and the suction check valve housings and the connections between the discharge check valve housings and the outlet manifold, and the connections between the pumped fluid inlet ports and the suction check valve housings and the connections between the suction check valve housings and the pumped fluid outlet ports;

two chamber covers each delimiting an outer side of the respective operating fluid chambers and each fastened to the central pump body independently of the other chamber cover, independently of the inlet manifold and independently of the outlet manifold, wherein each chamber cover comprises:

an operating fluid manifold communicating the operating fluid between an operating fluid distribution module and the respective operating fluid chamber;

a throttle valve disposed in an inlet, the inlet guiding flow into one of the operating fluid manifolds from the fluid distribution module, and a sensor valve configured to detect an end of stroke position of the respective diaphragm when it reaches its outermost position and to send at the end of stroke an operating fluid impulse to the distribution module via the respective operating fluid manifold;

the operating fluid distribution module being disposed above the central pump body, connected to both of the chamber covers, and including a pivoting sealing member, the pivoting sealing member rotating, in a horizontal plane, alternatively in a clockwise and anticlockwise direction, at a location of a flow of operating fluid into the operating fluid distribution module, and the pivoting sealing member comprising;

a protruding wing;

an inlet sealing cylinder with a circular sealing lip on each of the two circular sides of the cylinder configured to control the communication of the operating fluid between the operating fluid distribution module and alternatively, via the respective chamber cover operating fluid manifolds, each of the operating fluid chambers and a protrusion with a truncated spherical surface being supported by, pivoting against and sealing against a low friction seal housed in the center of the operating fluid distribution module, and two diaphragms each comprising:

an undulating profile that fits the profile of the chamber covers as the diaphragms are completing a suction stroke towards the chamber covers, and that fits the concave sides of the central pump body as the diaphragms are completing a discharge stroke towards the central pump body, and a flange sealing bead preventing pumped fluid and operating fluid leaking between the chamber covers and the central pump body.

2. The pump of claim 1, wherein the operating fluid distribution module comprises:

an operating fluid inlet cavity comprising two operating fluid inlet ports one on either side of the operating fluid inlet cavity, and an operating fluid outlet cavity comprising two operating fluid outlet ports on either side of the operating fluid outlet cavity, and wherein the pivoting sealing member of the operating fluid distribution module is a low friction pivoting sealing member, wherein the protruding wing of the pivoting sealing member includes a tip facing the flow of the operating fluid into the operating fluid inlet cavity, the tip having a chamfer on one long side of a rectangular section thereof facing the flow of operating fluid such that when operating fluid flows into the operating fluid inlet cavity the pivoting sealing member is not balanced in a central position within the operating fluid distribution module;

wherein the sealing lip on each circular side of the inlet sealing cylinder of the pivoting sealing member is configured to permit the passage of operating fluid into one of the operating fluid inlet ports whilst sealing closed the other inlet port;

wherein the protrusion of the pivoting sealing member seals against the low friction seal located in the center of the operating fluid distribution module such that the operating fluid is prevented from flowing directly from the operating fluid inlet cavity into the operating fluid outlet cavity, and wherein the pivoting sealing member further comprises an outlet sealing cylinder with a sealing lip on each circular side of the outlet sealing cylinder configured to permit the passage of operating fluid out of one of the operating fluid outlet ports whilst sealing closed the other outlet port.

3. The pump of claim 1, wherein the sensor valve comprises:

a sensor chassis;

a gasket;

an actuating button;

a ball valve seat;

an o-ring seal, and a ball valve, and one of the chamber covers includes a throttle valve in one channel of its operating fluid manifold leading from the corresponding operating fluid inlet port of the operating fluid distribution module to the corresponding operating fluid chamber wherein the operating fluid distribution module, the chamber cover operating fluid manifolds and the sensor valves are configured to allow the pressurized operating fluid to act constantly on the sensor valves;

each sensor valve is configured to open when the diaphragm on the same side of the pump as the sensor valve reaches its end of stroke towards the sensor valve;

each sensor valve, and the chamber cover operating fluid manifold in the chamber cover including the sensor valve, and the operating fluid distribution module, are configured to allow the operating fluid to flow, when the sensor valve is opened, from the sensor valve, through the chamber cover operating fluid manifold, and to the operating fluid distribution module to apply an impulse force to the side of the inlet sealing cylinder on the same side of the pump as the sensor valve, to cause the pivoting sealing member to change position; and the throttle valve is configured to reinforce the functioning of the pivoting sealing member by breaking a symmetrical functioning of the pump and so prevent the pivoting sealing member and hence the pump from stopping or stalling.

4. The pump of claim 1, wherein the two suction check valve housings and the two discharge check valve housings include housing openings in the upper ends of the check valve housings and one removable access cap closes and seals the two suction check valve housing openings and a second removable access cap closes and seals the two discharge check valve housing openings.

5. The pump of claim 1, wherein within each pumped fluid chamber the pumped fluid chamber inlet port is above the shaft towards the upper periphery of the fluid chamber, and the outlet port is below the shaft outlet manifold and towards the lower periphery of the fluid chamber and the inlet port and outlet port are diagonally opposite from one another to ensure a fluid flow from the top towards the bottom and out of the chambers, thus eliminating zones of zero and very low flow velocity where sedimentation could otherwise occur in the pumped fluid chambers.

6. The pump of claim 1, wherein the housings of the four check valves form, in the case of the suction valves, the pumped fluid chamber inlet ports located above the shaft and form, in the case of the discharge valves, the pumped fluid chamber outlet ports located below the shaft, so eliminating the need for manifolds between the check valves and the pumped fluid chamber inlet and outlet ports.

7. The pump of claim 1, wherein the two suction check valve housings and the two discharge check valve housings comprise housing openings in the upper ends of the check valve housings;

one removable access cap closes and seals the two suction check valve housing openings and a second removable access cap closes and seals the two discharge check valve housing openings, and the access caps are independent of the connections between the inlet and outlet manifolds and the check valve housings and are independent of the connections between the pumped fluid inlet and outlet ports and the check valve housings, to permit access to the check valve housings and the check valves without disconnecting either the inlet or the outlet manifold from hoses or pipes connecting to the pump and without disassembling either the inlet or the outlet manifold from the pump.

8. The pump of claim 1, comprising two independent suction inlets, one suction inlet connecting to each of the two pumped fluid chambers.

9. The pump of claim 1, wherein the diaphragms are elastic diaphragms and are not fastened to the shaft and wherein each diaphragm is configured such that the diaphragm is in a relaxed state at the end of a suction stroke and the diaphragm stores elastic energy during its deformation during a discharge stroke and the diaphragm assists a suction stroke by returning the elastic energy during the suction stroke.

10. The pump of claim 1, wherein the chamber covers, are independent of the inlet and outlet manifolds.

11. The pump of claim 1, wherein an automatic external controller controls the pump and/or comprising an integrated controller controlling the pump.

* * * * *